United States Patent [19]

Russell

[11] Patent Number: 4,861,123

[45] Date of Patent: Aug. 29, 1989

[54] INTEGRAL SLIDE FORMED FROM DRAWER SHELL

[75] Inventor: Milo F. Russell, Waterloo, Iowa

[73] Assignee: Waterloo Industries, Inc., Waterloo, Iowa

[21] Appl. No.: 268,670

[22] Filed: Nov. 2, 1988

Related U.S. Application Data

[63] Continuation of Ser. No. 110,554, Oct. 19, 1987, abandoned, which is a continuation of Ser. No. 621,423, Jun. 18, 1984, abandoned.

[51] Int. Cl.[4] ..... A47B 88/00

[52] U.S. Cl. ..... 312/330.1; 384/23; 312/338

[58] Field of Search ..... 312/330 R, 330 SM, 335, 312/336, 338, 346, 347, 350, 273, 274, 343, 344; 220/7; 160/201, 208, 215; 49/459; 16/96 R

[56] References Cited

U.S. PATENT DOCUMENTS

| | | | |
|---|---|---|---|
| 1,496,099 | 6/1924 | O'Connor | 312/348 |
| 1,837,820 | 12/1931 | Holliman | 312/346 |
| 2,265,927 | 12/1941 | Pratt | 312/338 |
| 2,539,963 | 1/1951 | Moberg | 312/346 |
| 2,599,240 | 6/1952 | Ellerson | 312/346 |
| 3,377,115 | 4/1968 | Hansen | 312/330 R |
| 3,450,304 | 6/1969 | Schreyer | 312/330 R |
| 4,072,375 | 2/1978 | Boone | 312/346 |
| 4,384,764 | 5/1983 | Ferdinand et al. | 312/338 |
| 4,440,461 | 4/1984 | Powell et al. | 312/330 R |

FOREIGN PATENT DOCUMENTS

| | | | |
|---|---|---|---|
| 2130472 | 6/1984 | United Kingdom | 312/330 R |

*Primary Examiner*—Kenneth J. Dorner
*Assistant Examiner*—Gerald A. Anderson
*Attorney, Agent, or Firm*—Allegretti & Witcoff, Ltd.

[57] ABSTRACT

A drawer with integral drawer slides is roll formed from a drawer blank.

3 Claims, 2 Drawing Sheets

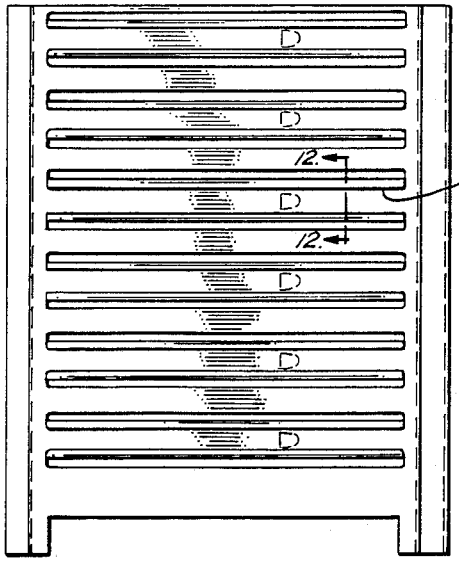
Fig. 10
(PRIOR ART)
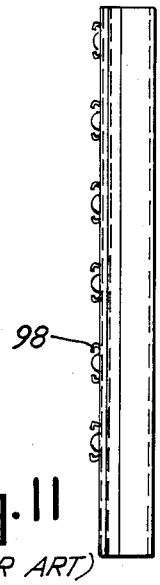
Fig. 11
(PRIOR ART)
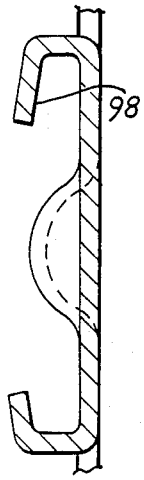
Fig. 12
(PRIOR ART)
Fig. 2
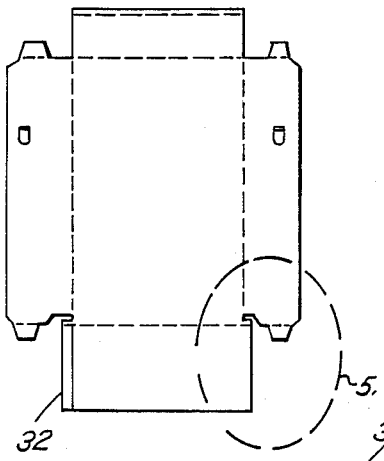
Fig. 3
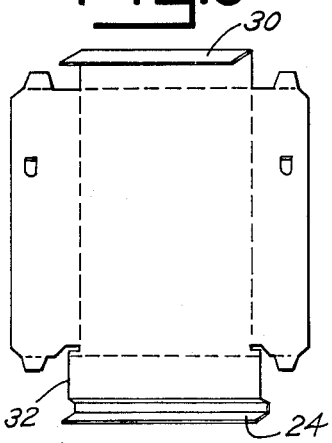
Fig. 4
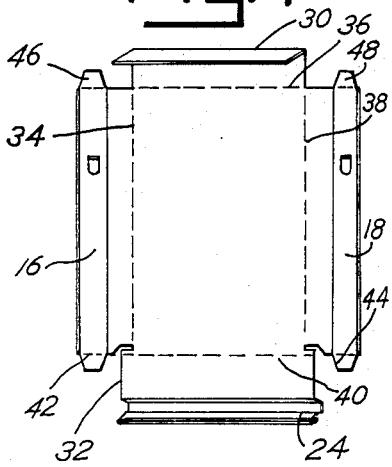
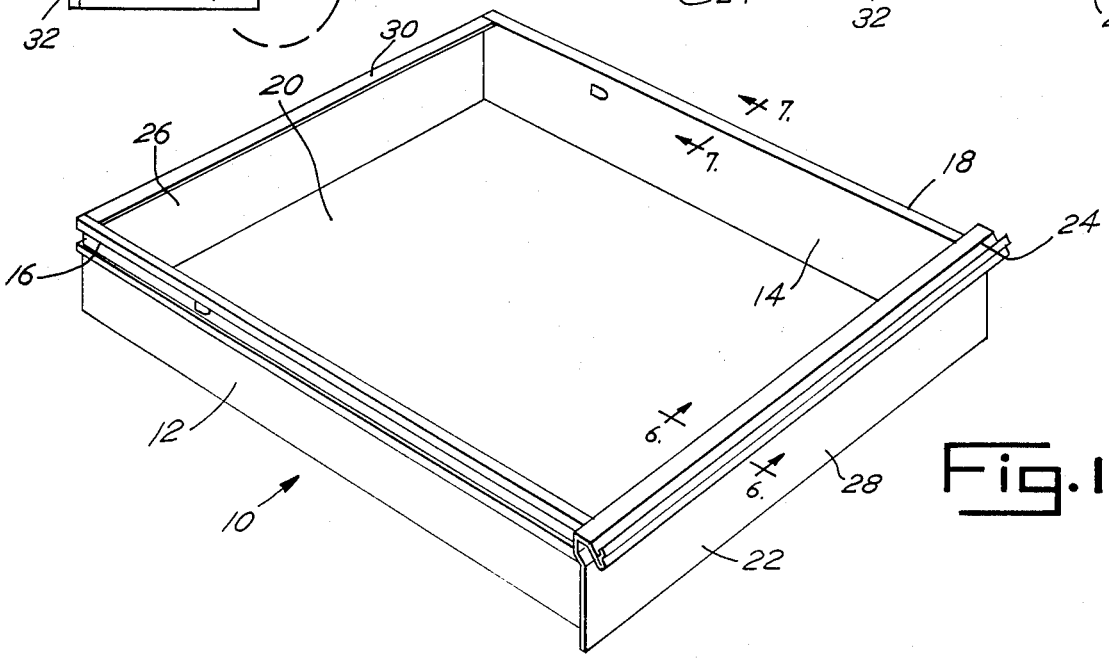
Fig. 1

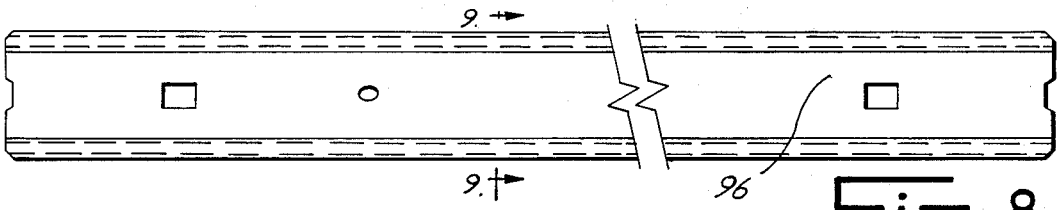
Fig. 8
(PRIOR ART)
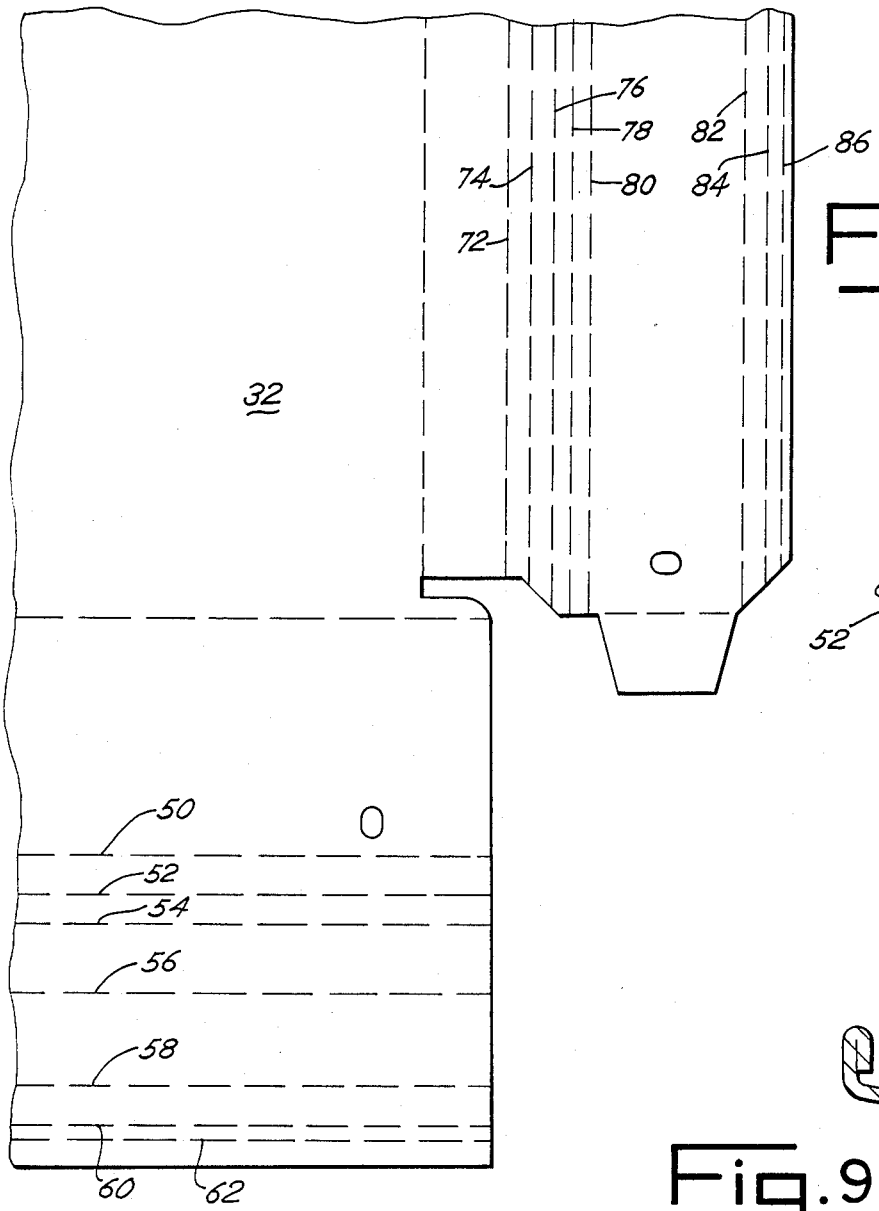
Fig. 5
Fig. 6
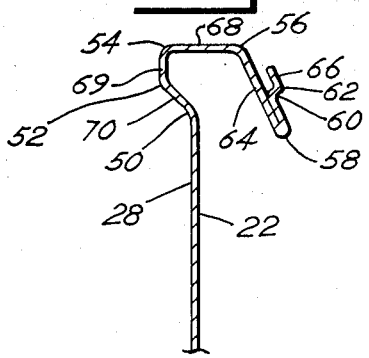
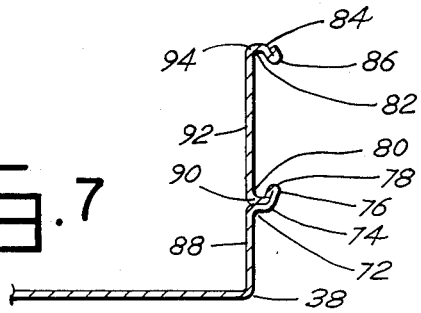
Fig. 7
Fig. 9
(PRIOR ART)
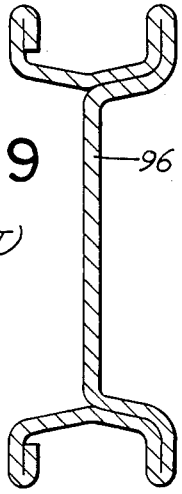

INTEGRAL SLIDE FORMED FROM DRAWER SHELL

This application is a continuation of application Ser. No. 07/110,554, filed Oct. 19, 1987 (now abandoned) which is a continuation of Ser. No. 621,423 filed June 18, 1984 (now abandoned).

BACKGROUND AND SUMMARY OF THE INVENTION

This invention relates to cabinet drawers and more particularly, to drawer slides.

In a principal aspect, the invention is a drawer comprising a bottom and sidewalls incorporating drawer slides. The sidewalls include a lower side wall portion adjacent the bottom, and a lower slide portion adjacent the lower side wall portion. The lower slide portion extends outward of the lower side wall portion. A central slide portion is adjacent the lower slide portion, and inward of the lower slide portion. An upper slide portion is adjacent the central slide portion and extends outward of the central slide portion. The lower, central and upper slide portions form the drawer slides. Together with the lower sidewall portions, the drawer slides form the sides of the drawer.

BRIEF DESCRIPTION OF THE DRAWING

The accompanying drawing includes twelve figures, briefly described as follows:

FIG. 1 is a perspective view of the drawer 10 which is the preferred embodiment of the invention;

FIG. 2 is a plan view of a drawer blank 32 from which the drawer 10 is formed;

FIG. 3 is a view of the drawer blank 32 during a first stage of forming;

FIG. 4 is a view of the drawer blank 32 during a second stage of forming;

FIG. 5 is a detail view of the drawer blank 32 in the area of the oval 5 in FIG. 2;

FIG. 6 is a cross section view of the front of the drawer 10 taken along line 6—6 of FIG. 1;

FIG. 7 is a cross-section view of the side of the drawer 10 taken along line 7—7 of FIG. 1;

FIG. 8 is an elevation view of inside slides for cooperation with the drawer 10;

FIG. 9 is a cross-section view of the inside slide taken along line 9—9 in FIG. 8;

FIG. 10 is an elevation view of a plurality of lanced slide carriers for cooperating with the drawer 10;

FIG. 11 is a side view of the lanced slide carriers of FIG. 10;

FIG. 12 is a cross-section view of a lanced slide carrier taken along line 12—12 in FIG. 10.

DETAILED DESCRIPTION OF THE PREFERRED EMBODIMENT

Referring to FIG. 1, the preferred embodiment of the invention is a drawer 10 having sidewalls 12, 14 incorporating integrally formed drawer slides 16, 18. The preferred embodiment 10 is but one embodiment of the invention. Except to the extent included expressly or implicitly in the claims, the details of the preferred embodiment 10 do not restrict the scope of this patent.

Returning to FIG. 1, the drawer 10 further includes a bottom 20, a front 22 incorporating an integral handle 24, and a back 26. The bottom is planar, rectangular, and of any reasonably desired length and width. The front 22 is upright, perpendicular and generally rectangular. The front includes a lower front portion 28 which is planar. The back 26 is upright, rectangular and planar, with an inturned upper edge 30.

Referring to FIG. 2, the drawer 10 is the product of a process which begins by cutting a drawer blank 32 from a single planar sheet of formable sheet material, such as sheet steel. Referring to FIGS. 3–4, the process continues with roll forming or folding the drawer blank 32 to define the features of the drawer 10. As in FIG. 3, the blank 32 is folded to form the back upper edge 30 and the handle 24. As in FIG. 4, the blank 32 is then folded to form the drawer slides 16, 18. The drawer blank 32 is then folded along the bottom fold lines 34, 36, 38, 40 to form the sides, front and back 12, 14, 22, 26 as perpendicular to the bottom 20. Folding and spot welding of the side tabs 42, 44, 46, 48 to the front and back 22, 26 of the drawer 10 completes the drawer 10.

Referring to FIG. 5, the forming of the handle 24 includes folding of the blank 32 along seven parallel handle fold lines 50, 52, 54, 56, 58, 60, 62, also shown on FIG. 6. The resulting handle 24 includes, as best seen in FIG. 6, a partially double walled or layered hand gripping portion 64, an ornamental ridge portion 66, a handle top portion 68, a handle recessed portion 69, and a handle angled portion 70. The drawer front 22 incorporates the handle 24 in that the handle is formed in and as a part of the front 22. The handle 24 and front 22 are formed of the same sheet or drawer blank 32.

The first handle front line 50 forms an edge between the lower front portion 28 of the front 22 and the handle 24. The handle angled portion 70 extends from the line 50, upwardly and inwardly of the portion 28, at an angle, toward the center of the drawer 10. The fold line 52 forms an edge between the angled portion 70 and the handle recessed portion 69. The portion 69 extends upright, and parallel to the lower front portion 28. The line 54 forms an edge between the recessed portion 69 and the handle top portion 68. The line 56 forms an edge between the portions 68, 64, and the lines 60, 62 form the ridge portion. The line 58 forms an edge and 360° turn between the layers 72, 74 of the hand gripping portion 64. The top portion 68 extends outward beyond the lower portion 28, and the gripping portion 64 extends downward and outward from the top portion 68.

Referring to FIG. 5 again, the forming of the drawer slides such as slide 18 includes folding of the blank 32 along eight drawer slide fold lines 72, 74, 76, 78, 80, 82, 84, 86, also shown in FIG. 7. The resulting slide includes a lower sidewall portion 88, a lower slide portion 90, a central slide portion 92 and an upper slide portion 94. The drawer sides incorporate all the portions 88, 90, 92, 94.

The lower sidewall portion 88 is planar, rectangular and perpendicular to the bottom 20. The fold line 38 forms the bottom edge of the lower sidewall portion 88. The first drawer slide fold line 72 forms the top edge of the portion 88, and the edge between the portion 88 and the lower slide portion 90. A first segment of the lower slide portion 90 is adjacent the line 72, and extends perpendicular to the lower sidewall portion 88. A second segment of the lower slide portion 90 extends or angles upward and outward from the first segment, to the outer edge of the portion 90. The second drawer slide fold line 74 forms an edge between the first and second segments. The third fold line 76 forms the outer edge of the portion 90.

The fold line 76 also forms a 360° turn between the second segment and a third segment. The third segment overlies the second segment, and a fourth segment overlies the first segment. The first and second segments form an underlying layer of the lower slide portion 90, and the third and fourth segments form an overlying layer thereof. The fourth fold line 78 forms an edge between the third and fourth segments. The fifth fold line forms an edge between the fourth segment and the central slide portion 92.

The central slide portion 92 is planar, upright, parallel to and coplanar with the lower sidewall portion 88. The portion 92 extends from the line 80 to the sixth drawer slide fold line 82. The line 82 forms an edge between the portion 92 and a first segment of the upper slide portion 94.

The first segment of the upper slide portion 94 extends outward perpendicular to the second slide portion 92. The seventh drawer slide fold line 84 forms an edge between the first segment of the upper slide portion and a second segment thereof. The second segment extends or angles downward and outward of the first segment toward the lower slide portion 90. The eighth fold line 86 forms an edge and 360° turn between the second segment and a third segment, which completes the upper slide portion 94.

The drawer 10 is now described. The drawer slides 16, 18 cooperate with inside slides 96, such as the one shown in FIGS. 8 and 9, and lanced slide carriers 98, such as the ones shown in FIGS. 10–12. Together, a plurality of drawers 10, inside slides 96, lanced slide carriers 98 and sheet metal work form cabinets as desired.

The preferred embodiment of the invention is now described. To particularly point out and distinctly claim the subject matter regarded as invention, the following claims conclude this patent.

What I claim and regard as invention is:

1. A drawer in a cabinet having a bottom, sidewalls including integral opposed drawer slides, a front wall, and a back wall formed from a single metal sheet by a process comprising the steps of:

bending a back portion of said single metal sheet to form a back boundary of said bottom and said back wall;

bending a front portion of said single metal sheet to form a front boundary of said bottom and said front wall;

bending two side portions of said single metal sheet along a multiplicity of side fold lines to form boundaries of said bottom and said sidewalls; said multiply folded sidewalls each having a continuous cross-section including a lower sidewall portion extending from said side boundary, a lower slide portion, a central slide portion substantially coplanar with said lower sidewall portion, and an upper slide portion to engage said cabinet;

said lower, central and upper slide portions defining one of said integral opposed drawer slides;

said lower slide portion including first and fourth lower segments extending adjacently and substantially perpendicularly from said lower sidewall portion and second and third lower segments extending at a first predetermined angle from said first and fourth segments, respectively;

said upper slide portion including first and fourth upper segments extending substantially adjacently and substantially perpendicular from said central slide portion and including second and third upper segments extending at a second predetermined angle from said first and fourth upper segments, respectively.

2. A drawer as claimed in claim 1 wherein said side fold lines are substantially parallel.

3. A drawer as claimed in claim 2 wherein said front wall includes a handle and said process further comprises bending said front portion along a multiplicity of front fold lines to form said handle.

* * * * *